US005636740A

United States Patent [19]

Finkiewicz et al.

[11] Patent Number: 5,636,740

[45] Date of Patent: Jun. 10, 1997

[54] MULTI-ELEMENT DECORATIVE DISPENSING CLOSURE

[75] Inventors: Daniel J. Finkiewicz, Schaumburg; Gerald R. Sorensen, Elgin, both of Ill.

[73] Assignee: NCM International, Inc., Arlington Heights, Ill.

[21] Appl. No.: 229,251

[22] Filed: Apr. 18, 1994

[51] Int. Cl.[6] ..... B65D 41/04; B65D 51/24

[52] U.S. Cl. ..... 206/457; 215/329; 220/259; 220/375

[58] Field of Search ..... 215/200, 235; 220/200, 259, 256, 375; D9/310, 311, 441, 451; 206/457

[56] References Cited

U.S. PATENT DOCUMENTS

| | | | |
|---|---|---|---|
| Re. 31,086 | 11/1982 | Johnson, Jr. et al. | 220/337 |
| D. 190,238 | 5/1961 | Blake | D9/451 X |
| 194,495 | 8/1877 | Atterbury . | |
| 222,780 | 12/1879 | Griffin . | |
| 818,798 | 4/1906 | Taylor . | |
| 1,325,269 | 12/1919 | Stanley . | |
| 1,723,799 | 8/1929 | McDougall . | |
| 1,787,183 | 12/1930 | Wild et al. . | |
| 2,448,893 | 9/1948 | Lamar | 215/43 |
| 2,460,488 | 2/1949 | Brunetti | 220/31 |
| 2,546,122 | 3/1951 | Goldfarb | 46/116 |
| 2,753,051 | 7/1956 | Tupper | 210/163.5 |
| 3,252,492 | 5/1966 | Marchant | 150/5 |
| 3,272,368 | 9/1966 | Van Baarn | 215/41 |
| 3,282,477 | 11/1966 | Henchert | 222/541 |
| 3,303,953 | 2/1967 | Frank | 215/38 |
| 3,497,908 | 3/1970 | Zamarra | 16/171 |
| 3,866,803 | 2/1975 | Kipfmueller | 222/179.5 |
| 4,036,357 | 7/1977 | Czelen | 206/5.1 |
| 4,065,035 | 12/1977 | Eissler | 222/153 |
| 4,127,221 | 11/1978 | Vere | 222/153 |
| 4,170,315 | 10/1979 | Dubach et al. | 220/281 |
| 4,201,310 | 5/1980 | Glachet | 220/256 |
| 4,253,488 | 3/1981 | Leverberg | 137/382 |
| 4,327,842 | 5/1982 | Walter | 220/367 |
| 4,462,504 | 7/1984 | Roth et al. | 220/214 |
| 4,519,517 | 5/1985 | Walter | 215/253 |
| 4,666,068 | 5/1987 | Bush | 222/546 |
| 4,711,363 | 12/1987 | Marino | 220/266 |
| 4,723,671 | 2/1988 | Mears | 215/228 |
| 4,742,928 | 5/1988 | Braun | 215/235 |
| 4,993,606 | 2/1991 | Bolen, Jr. et al. | 222/546 |
| 5,038,957 | 8/1991 | Gross | 220/335 |
| 5,065,911 | 11/1991 | Rohr, et al. | 222/517 |
| 5,105,959 | 4/1992 | Kinsley | 215/227 |
| 5,115,930 | 5/1992 | Lohrman et al. | 215/227 |
| 5,145,646 | 9/1992 | Tyranski | 422/102 |
| 5,150,801 | 9/1992 | Held | 215/11.6 |

FOREIGN PATENT DOCUMENTS 819617 11/1951 Germany .

*Primary Examiner*—Allan N. Shoap
*Assistant Examiner*—Robin A. Hylton
*Attorney, Agent, or Firm*—Wallenstein & Wagner, Ltd.

[57] ABSTRACT

An efficient, economical container closure means of a functional and decorative nature includes elements connectable together to provide a relatively simple, inexpensive, reliable, easy operable closure for dispensing a wide variety of materials and to provide a changeable decorative ornamental appearance. The elements include a base with an opening therein connectable to a container to close or restrict an opening therein, a cap tethered to the base operable to close the opening therein and having a connecting means cooperable with a decorative means.

9 Claims, 1 Drawing Sheet

MULTI-ELEMENT DECORATIVE DISPENSING CLOSURE

DESCRIPTION

1. Technical Field

This invention generally relates to dispensing closures for containers and more particularly concerns a multi-element closure adaptable to function as an efficient dispensing closure and provide a means for connecting one of a plurality of different decorative means, such as figurines, thereto. The decorative means also function as a means for assisting persons, particularly children, to open the closures. The elements are separable one from the other and the forces necessary to separate the elements differ in degree and may differ in kind.

2. Background of the Invention

Closures generally incorporating decorative means such as figurines include the types as shown in U.S. Pat. Nos. 2,546,122 and 3,303,953, for example, wherein the ornamental means has been made integral with a non-dispensing closure member respectively as by a mechanical fastening means or adhesive.

Multi-element dispensing closures as shown, for example, in U.S. Pat. Nos. 5,105,959 and 5,115,930 have included disc-like elements held in grooves on a cap structure which elements respectively serve an indicating or decorative purpose. None has a combination of features including a convenient plurality of elements of simple design and low cost that provide a base, tethered cap, intermediate attachment means of a pleasing appearance that not only makes possible attachment and removal of different three dimensional decorative means such as a figurine, but also provides differential detachment forces between the various elements that, for example, allow the decorative means to function as an aid to opening of the closure.

While inserts of different color and shape are known in connection with closures for facilitating simple distinctions in packaging appearance between variations within a product line, there has been a need for a simply constructed, rugged and reliable multi-element dispensing closure wherein, for example, the differential holding forces between the elements allow ornamental means such as three dimensional figurines to be detachably affixed to caps by means of an intermediate overcap that allows use of the figurine, for example, to provide aid to opening the cap, especially for small children.

SUMMARY OF THE INVENTION

In accordance with the invention as disclosed and claimed herein, there is provided a simply constructed dispensing closure structure of pleasing appearance made of four elements separable individually or in various combinations wherein, for example, the forces required to separate the various combinations are different. By this means, a three dimensional ornamental means such as a figurine may be used by persons such as children as an aid to opening the closure.

The arrangement allows a single standard dispensing closure to be used by itself, with a color and/or shape coded overcap and/or with any one of a plurality of different ornamental means.

Being able to separate the ornamental means from the overcap only with a predetermined higher degree of force than is necessary to separate the caps from the base allows normal use of the cap with the figurine affixed thereto but yet allows ultimate removal of the figurine should it be desired to separate and perhaps collect the different figurines.

DESCRIPTION OF THE DRAWINGS

An exemplary embodiment of the invention is schematically shown in the drawings and will be discussed in further detail herein.

DETAILED DESCRIPTION

Figure 1:
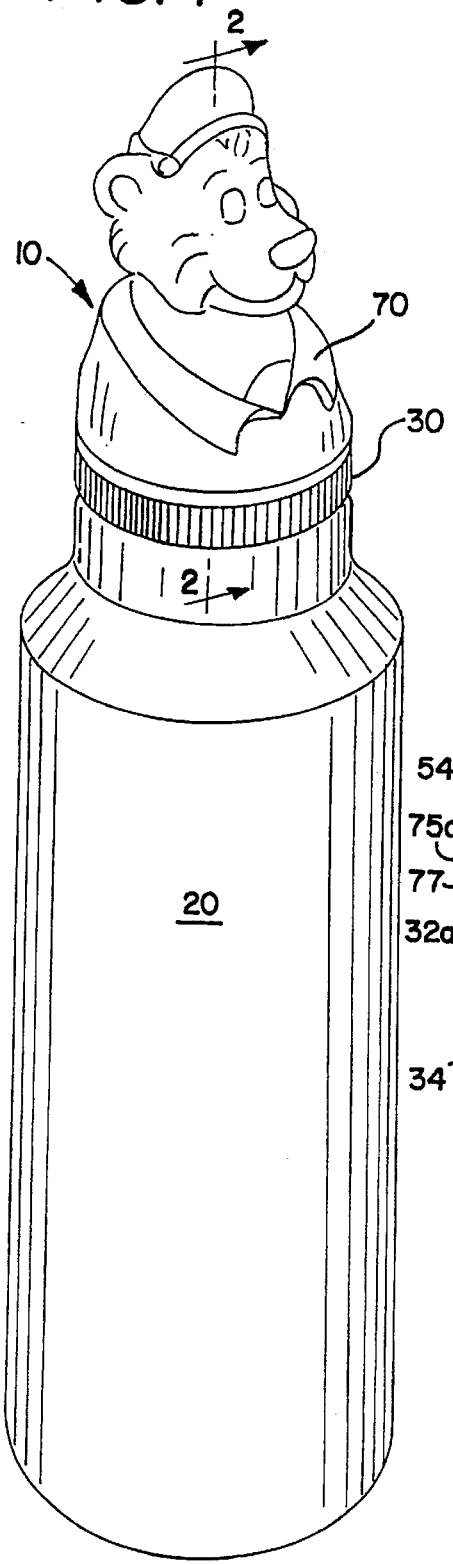
FIG. 1 is a perspective view of an embodiment of the closure on a bottle; and, FIG. 2 is a sectional view of the closure of FIG. 1 taken along lines 2—2 thereof.

While this invention is susceptible of embodiment in many different forms, there is shown in the drawings and will herein be described in detail a preferred embodiment of the invention with the understanding that the present disclosure is to be considered as an exemplification of the principles of the invention and not intended to limit the broad aspect of the invention to the embodiments illustrated.

Figure 2:
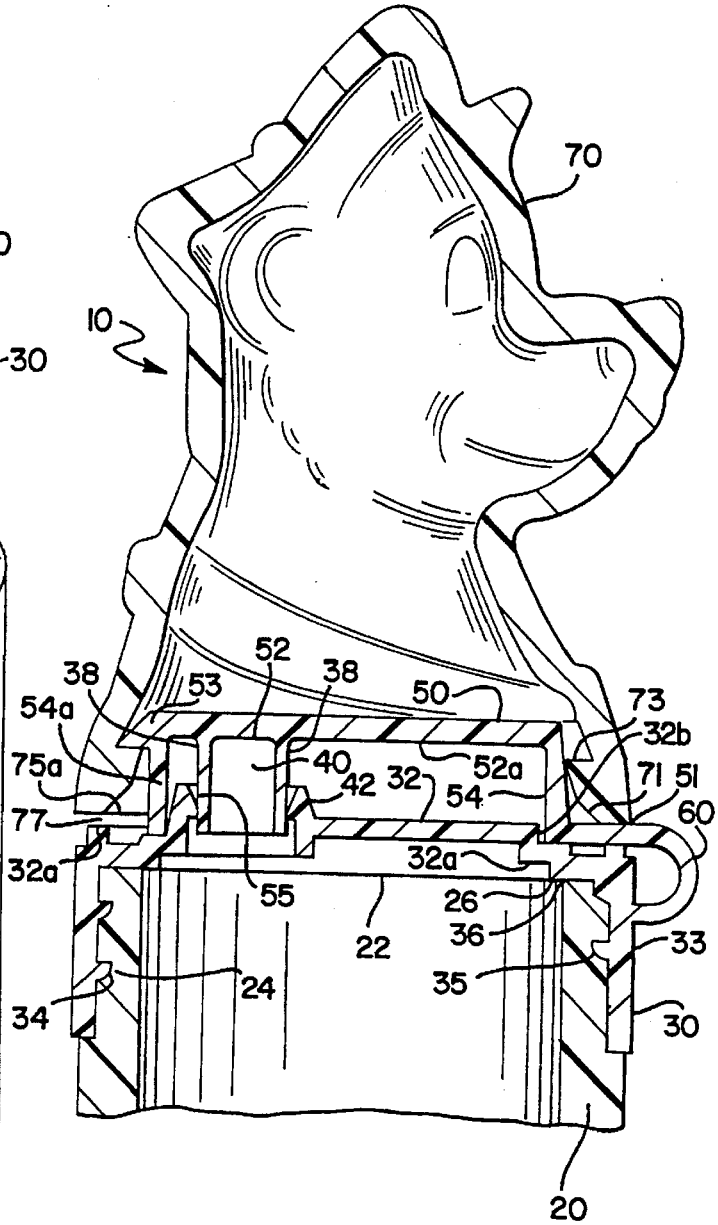

According to the embodiment of the invention as shown in FIGS. 1 and 2, a plastic closure, generally indicated at 10, is adapted to be attached to a container 20 to sealingly close a circular opening 22 in the container. The container 20 may be of any suitable construction for containing liquids, particulate matter, etc., as is well know.

The closure 10 includes a base 30 having a panel generally indicated at 32 adapted to span and overlie the opening 22 in the container 20. As shown, the panel 32 has a panel opening 40 therethrough allowing communication between the interior of container 20 and the outside. A generally cylindrical depending skirt, generally indicated at 33, is integral with and depends from the periphery of the panel 32. The attachment of the closure 10 to the container 20 may be by a first connection means 35 comprising an interfitting screw thread wherein integral helical threads 34 engage mating helical grooves 24. As is well known, rotary application motion connects the helical threads 34 on the base 30 to the helical grooves 24 on the container 20 to sealingly attach the base 30 and connected closure 10 to the container 20 and block the container opening 22 except for the panel opening 40. Appropriate sealing surfaces 36 on the base 30 are adapted to engage a lip 26 on the container 20 surrounding the container opening 22.

A cap generally indicated at 50 is tethered to the base 30 by an integral flexible hinge 60. The cap 50 is movable between a first position overlying the panel opening 40 in the base and a second position exposing the opening. A second connection means 55 connects the cap 50 to the base 30 when the cap 50 is in its first position and thereby sealingly closes the panel opening 40 in the base 30. The second connection means 55 comprises a plug 38 depending from a lower surface **52*a* of the cap 50 and adapted to sealing close the panel opening 40**.

The cap 50 comprises a first portion 52 generally overlying the base 30 when in the closed first position and a second portion 54 angularly related to the first portion and depending therefrom. The panel opening 40 in the base 30 has an upstanding collar structure 42 above the opening and extending thereabout. The collar 42 frictionally engages the plug 38 depending from the first portion 52. The plug 38 is of a size and configuration to frictionally engage the collar 42 and close the panel opening 40.

The second portion 54 is of a length in an area adjacent to the plug 38 so that it abuts against an upper surface **32*a*** of the panel 32 to thereby limit movement of the plug 38 into the panel opening 40. As shown, the panel opening 40 and the surrounding collar 42 are somewhat off center to facilitate pouring and dispensing of contents of the container 20. The outer configuration of the collar 42 may be tapered so that upon engagement by the lower portion 54*a* of the cap 50 it will serve to guide the plug 38 into the panel opening 40 and help position the cap 50 on the base 30. Other guide means such as a ridge 32*b* further serve to help position the cap on the base.

A decorative means, such as a figurine generally indicated at 70, has a first opening 71. The figurine 70 has inwardly projecting protrusions 73 adapted to frictionally engage outwardly projecting protrusions 53 on the outer periphery of the first portion 52 of the cap 50. More specifically, a third connecting means for retaining the figurine 70 on the cap 50 includes the inwardly projecting protrusions 73 around the interior of the first opening 71 and the outwardly projecting protrusions 53 on the first portion 52 of the cap 50. The outward portion of the outwardly projecting protrusions 53 is of a greater size than the inward portion of the inwardly projecting protrusions 73 whereby it is possible to prevent removal of the figurine 70 from the cap 50 without deformation of the protrusions 73,53 and/or figurine 70 and/or the cap 50. This effective mechanical connection means between the figurine 70 and the cap 50 requires a greater separation force than that required to separate the plug means 38 from the panel opening 40.

The amount of force necessary to remove the figurine 70 from the cap 50 may be varied by means of the differential sizes, as well as the flexibility of the material from which the figurine 70 is manufactured together with the shape of the interfitting portions and the lubricity of their surfaces. In any event, it is a feature of this invention that the force necessary to remove the figurine 70 is greater than the force necessary to remove the plug 38 from the panel opening 40 whereby forces applied to the figurine 70 will be transmitted to the cap 50 to cause the cap 50 and its attached plug 38 to be removed from the closure or the panel opening 40.

In practice, it has been found that materials suitable for the manufacture of the base 30 and cap 50 include polypropylene, polyethylene and other polymers, while the material used to manufacture the figurine 70 is a relatively soft, polypropylene blend.

The integral flexible hinge 60 holding the cap 50 onto the base 30 preferably is of a strap-like configuration as shown, for example, in FIG. 2. In practice it has been found that a thickness of fifty thousandth of an inch provides excellent results. As shown, the integral flexible hinge 60 is integrally molded and projects from approximately the center portion of the depending skirt 33 and is integrally formed with one edge portion 51 of the cap 50. The length of the integral flexible hinge 60 also assists in helping align the second connection means 55 with the panel opening 40 to facilitate closing of the cap 50 on the base 30. Other interfitting configurations of the base 30 and the cap 50 also facilitate the accurate closure of the plug 38 in the panel opening 40. These may include the ridge 32*b* surrounding the panel 32, which interfits with and guides the second portion 54 of the cap 50 and the upper surface 32*a* which interfits with and guides the lower portion 54*a* of the depending cap 50.

Separation of the cap 50 from the base 30 is facilitated by a gap 77 which is provided between the upper surface 32*a* of the base 30 and the lower portion 75*a* of the figurine 70. The gap 77 allows a fingernail or other thin, relatively rigid member to be inserted therein and twisted to help facilitate removal of the cap 50, with its attached figurine 70 from the base 30.

From the foregoing it will be understood that the multi-element closure 10 is suitable for a wide variety of applications requiring a reliable, economical structure of pleasing appearance that allows the use of various figurines 70 and/or decorative elements to differentiate products. The multi-element closure 10 also provides a plurality of different decorative elements to encourage purchases of the same product to collect the various figurines 70 and/or decorative elements. At the same time, the figurine 70 and decorative elements are attached by connection means that, while allowing easy assembly, require an extraordinary force and/or unobvious technique to remove them whereby casual removal or misappropriation is discouraged if not impossible. The integral flexible hinge 60 gives further protection against removal and the possibility of loss. This is important also on children's products where complete separation is inconvenient and may result in loss.

Use by children is further facilitated by the ease of opening afforded by the extra lever arm length of the ornamental means of the figurines 70 and/or decorative elements and the differential separation forces between the various elements. By this means a child can "push or pull the puppet" to separate the cap 50 from the base 30 and open the container.

Further, the plug 38 provides a controllable frictional interlock while at the same time functioning to keep the opening from clogging with the drying of the contents in the container 20.

Other variations of the different connection means are within the contemplation of this inventor. Thus, for example, the first connection means 35 may be a snap fit rather than a screw thread; the second connection means 55 may be a snap fit and/or an auxiliary latch rather than the friction fit; the third connection means may be threaded connections, etc.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. A plastic closure adapted to be attached to a container to sealingly close an opening in said container comprising:

a base adapted to be connected to said container with a first connection;

a cap detachably connected to said base via a second connection;

a decorative means for aesthetically covering said cap and is detachably connected to said cap by a third connection;

said base having a panel adapted to span said opening in said container, said panel having a dispensing opening therethrough;

said first connection being integral with said panel and adapted to connect said panel to said container to sealingly block said container opening;

said cap being movable between a first position overlying and closing said opening in said panel and a second position opening said opening in said panel;

said second connection including a plug integral with said cap to connect said cap to said base when in said first position and thereby sealingly closing said opening in said base; and said third connection including interfitting portions on said cap and a lower portion of said decorative means detachably connecting said decorative means to said cap, said third connection requiring a greater force to separate than said second connection between said base and said cap.

2. A plastic closure according to claim 1 wherein said first connection includes screw threads and said cap is applied to and removable from said container by rotary motion therebetween; wherein said second connection is detachable by general relative pivotal movement between said base and cap; and, wherein said third connection is separable and connectable by a combination of relative pivotal and/or axial motion.

3. A plastic closure including:

a base to be removably attached to a container by a first connection, said base closing said container except for an opening therethrough;

a cap to overlie said base, having a means to close said opening, said cap being connected by second connection to said base via the means to close said opening in said base; and a decorative means for aesthetically covering said cap and is detachably connected to said cap by a third connection; wherein said third connection requires more force to detach than said second connection whereby said opening may be opened and closed by grasping said decorative means.

4. A plastic closure according to claim 3 wherein said second connection is a plug frictionally fitted in said opening in said base and said third connection includes a flexible abutment connection which must be deformed to be attached or detached.

5. A plastic closure according to claim 3 wherein said cap is integrally connected to said base by an integral flexible hinge.

6. A plastic closure according to claim 5 wherein said integral flexible hinge is integrally formed with said cap and said base.

7. A plastic closure according to claim 4 wherein said base and said cap have cooperating interfitting guide means to help guide the plug into the opening in said base.

8. A plastic closure according to claim 7 wherein said guide means includes a collar surrounding said opening in said base and a depending skirt portion on said cap wherein said skirt portion is adapted to bear against said collar during movement of said plug toward said opening.

9. A plastic closure according to claim 3 wherein detachment of said cap from said base is facilitated by a gap between a portion of an upper surface of said base and an overlying lower surface of said cap whereby a relatively rigid member may be inserted therebetween to provide a mechanical separating force.

* * * * *